US005222624A

United States Patent [19]

Burr

[11] Patent Number: 5,222,624

[45] Date of Patent: Jun. 29, 1993

[54] TICKET DISPENSER MACHINE AND METHOD

[75] Inventor: Robert L. Burr, San Diego, Calif.

[73] Assignee: Donald Sutherland, Rancho Santa Fe, Calif. ; Trustee of the Ralph L. Evans Trust

[21] Appl. No.: 912,005

[22] Filed: Jul. 10, 1992

Related U.S. Application Data

[63] Continuation of Ser. No. 312,111, Feb. 17, 1989, abandoned.

[51] Int. Cl.[5] ..... G07F 11/00

[52] U.S. Cl. ..... 221/1; 221/2; 221/8; 221/13; 221/25; 221/124; 221/129; 221/155

[58] Field of Search ..... 221/1, 2, 3, 8, 9, 10, 221/13, 25, 26, 30, 92, 123, 124, 129-131, 155, 191, 194, 195, 206, 207; 235/375; 364/479

[56] References Cited

U.S. PATENT DOCUMENTS

| | | | |
|---|---|---|---|
| 1,813,935 | 7/1931 | Knee | 221/25 |
| 2,657,750 | 11/1953 | Webb . | |
| 2,865,699 | 12/1954 | Fitzgerald . | |
| 3,047,347 | 7/1962 | Groves | 221/25 X |
| 3,935,978 | 2/1976 | Arp et al. . | |
| 4,094,451 | 6/1978 | Wescoat . | |
| 4,140,259 | 2/1979 | Kostka et al. . | |
| 4,157,670 | 6/1979 | Herring . | |
| 4,272,001 | 6/1981 | Horniak . | |
| 4,706,794 | 11/1987 | Awane et al. | 221/2 X |
| 4,738,384 | 4/1988 | Tigner . | |
| 4,766,548 | 8/1988 | Cedrone et al. | 221/9 X |
| 4,812,629 | 3/1989 | O'Neil et al. | 221/13 X |
| 4,858,806 | 8/1989 | Schafer . | |
| 4,982,337 | 1/1991 | Burr et al. . | |

*Primary Examiner*—David H. Bollinger
*Attorney, Agent, or Firm*—Gregor N. Neff

[57] ABSTRACT

Preferably, instant-winner lottery tickets are sold by the machine. The machine includes a bill acceptor to receive the money of the purchaser. It has from one to four windows in a front panel. Lottery tickets are displayed in the window and move past the window as they are being dispensed, thus allowing the buyer to see the messages and terms on the tickets themselves. When more than one window is provided in the machine, the buyer can select among a plurality of different instant-winner lottery games. The machine is connected electrically to a central computer for accounting and control functions. In another embodiment, representations of the tickets are displayed in a movable array on a video screen.

24 Claims, 6 Drawing Sheets

FIG.8
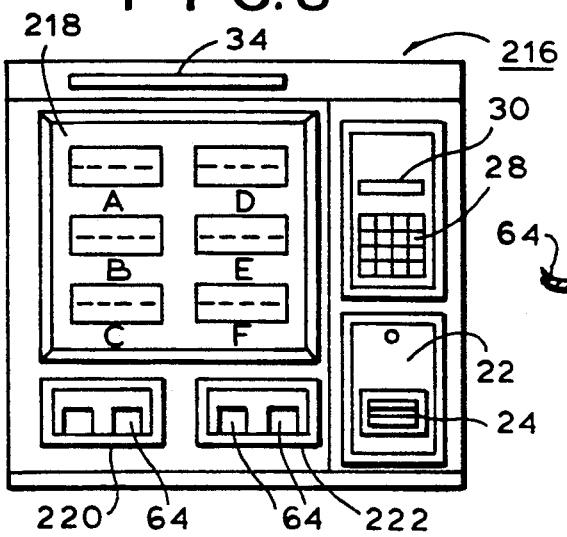
FIG.9
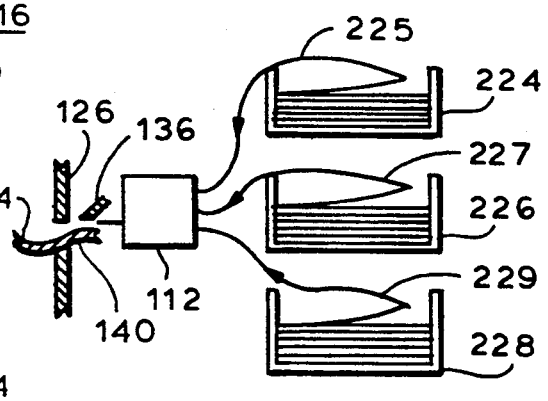
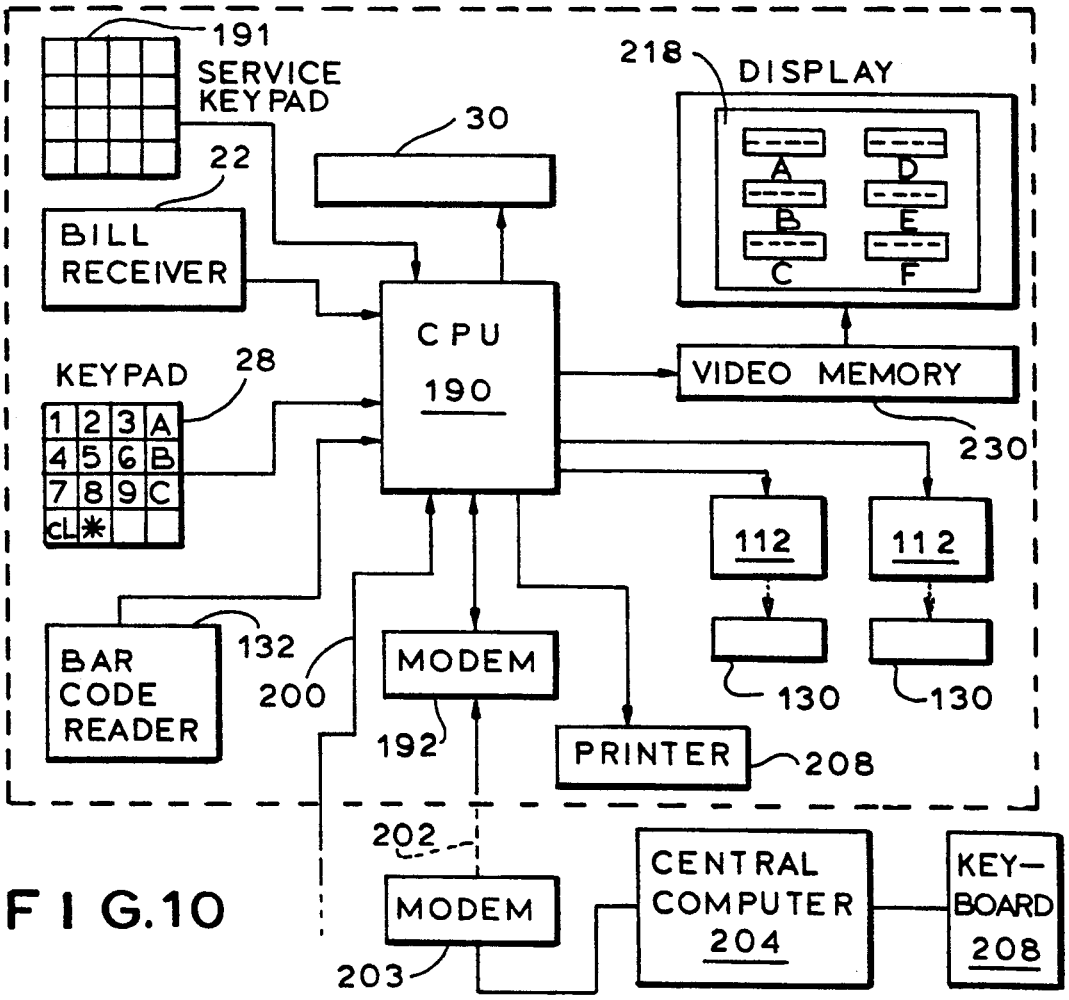
FIG.10

TICKET DISPENSER MACHINE AND METHOD

This application is a continuation of application Ser. No. 07/312,111, filed Feb. 17, 1989, now abandoned.

This invention relates to ticket dispensing apparatus and methods, and particularly to lottery ticket dispensing and vending machines and methods.

Described in my joint U.S. patent application Ser. No. 128,070 filed Dec. 3, 1987 with Laird A. Campbell, Donald H. Keagle and Alfred L. Fulton now U.S. Pat. No. 4,982,337, is a lottery ticket dispensing mechanism which is very advantageous. It is described as preferably being operated by a ticket agent, rather than by the customer himself. It advantageously stores lottery tickets in fan-fold form, bursts them apart accurately and reliably, and dispenses the tickets one-by-one.

That ticket dispenser is connected to a central computer through a modem and is adapted to deliver accounting, sales inventory and related information to the central computer, and print the information on a printed ticket delivered by the machine to the agent.

Although the machine of the above-described pending application is highly advantageous, it is an object of the present invention to improve upon it, and also to provide a customer-operated ticket vending machine and method which is improved in its ability to communicate to the customer the tickets available and to enhance customer confidence in the machine. Furthermore, it is desired to provide such a machine which is very easy for untrained people to operate, highly reliable in operation, and persuasive in its presentation of lottery tickets to the public.

In accordance with the present invention, the foregoing objects are met by the provision of a ticket dispensing apparatus and method in which a representation of the tickets is displayed by the machine at all times so that customers can see what they are buying. Then, as the tickets are being dispensed, the visible representation moves by an amount corresponding to the number of tickets dispensed.

In a preferred embodiment of the invention, the ticket dispensing machine and method is used as a vending machine in selling lottery tickets. The machine preferably has one or a plurality of windows with mechanism for moving an array of lottery tickets past each of the windows so that different types of lottery tickets can be seen, but not touched, by the customers. In a machine having a plurality of windows, the tickets displayed can either be separate sources of tickets of the same lottery game, or they can be tickets of different games so that the customer can select the game of his or her choice to play.

Preferably, the vending machines are connected by modems or similar communication links to a central computer which performs accounting and other similar functions. In one optional arrangement, several of the machines are used as slaves and are connected to one machine which is used as a master, and communications are had between the central computer and slaves and the master unit only through the master unit so that only one telephone line is required for the communication.

In another embodiment of the vending machine, graphic representations of the lottery tickets are displayed on a video screen, rather than through windows. The lottery ticket images are moved in the same manner as tickets are moved past windows.

The customer, by being able to see a representation of the lottery tickets prior to selecting them, better understands the terms of the game and has greater confidence that the machine will vend lottery tickets to him in a flawless manner. The motion of the tickets during dispensing further bolsters that confidence and is attractive. When multiple windows or video representations are used and multiple games are provided in a single machine, many more customers can be satisfied by one vending machine than if only one type of ticket were being sold.

The foregoing and other objects and advantages of the invention will be set forth in or apparent from the following description and drawings.

In the Drawings:

FIG. 8 is a front elevation view of another embodiment of the invention;

FIG. 9 is a side elevation schematic view of the ticket dispensing and bursting mechanism of the device shown in FIG. 8; and FIG. 10 is a schematic circuit diagram for the embodiment shown in FIGS. 8 and 9.

GENERAL DESCRIPTION

Figure 1:
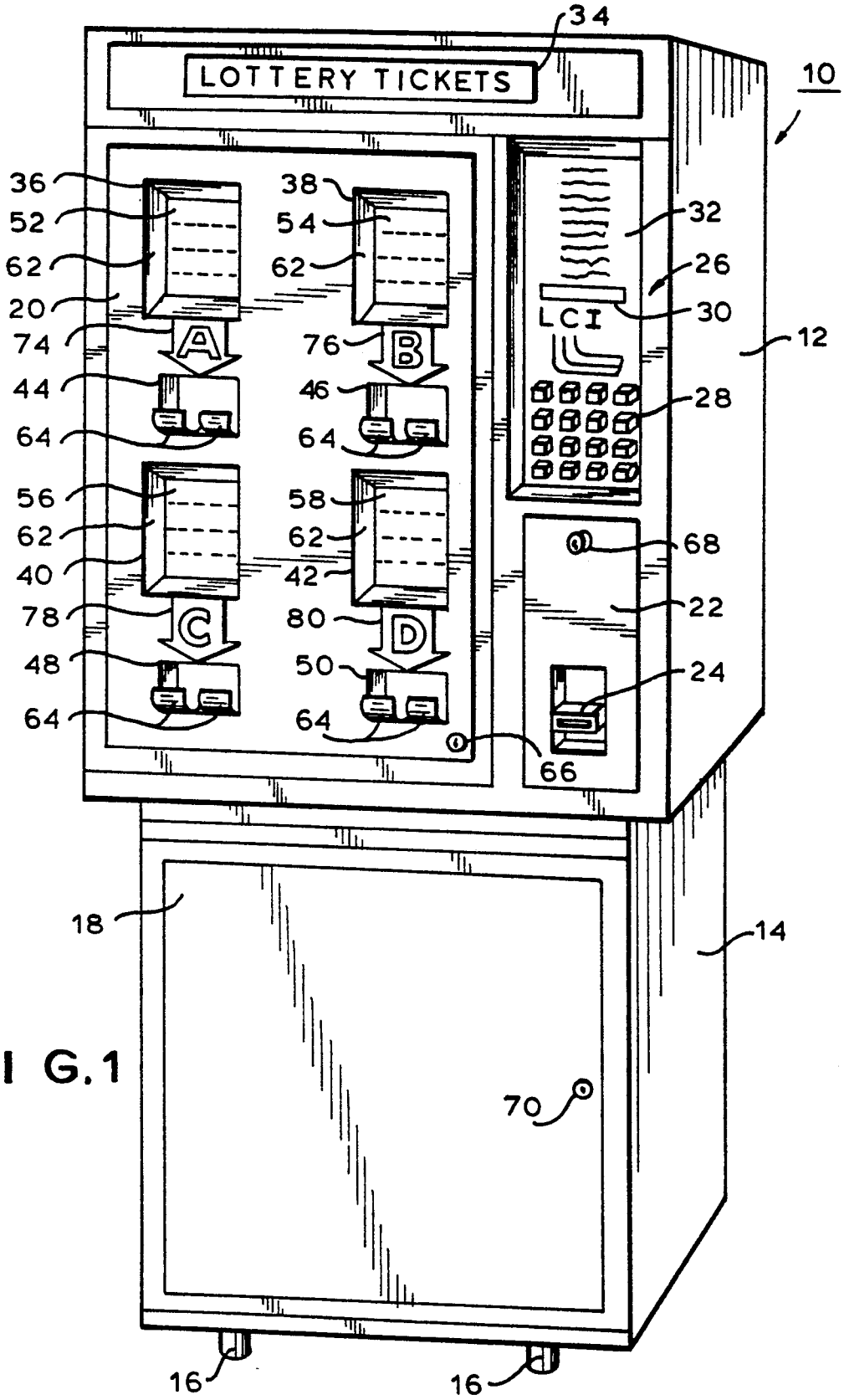
FIG. 1 is a perspective view of a ticket vending machine constructed in accordance with the present invention.

FIG. 1 is a perspective view of a lottery ticket vending machine 10 constructed in accordance with the present invention.

The vending machine 10 includes upper and lower housings 12 and 14 and support feet 16 for supporting the unit on the floor. The lower housing 14 forms a storage cabinet which has a hinged lockable front cover 18. The upper housing 12 has a hinged, lockable front cover 20.

The machine 10 includes a bill receiver or "acceptor" unit 22 which has an inlet slot 24 for receiving currency notes or bills. If desired, the unit 22 can be adapted to accept credit cards or other monetary exchange media.

The machine 10 has a control panel 26 with a keypad 28 and a LED display window 30. Printed operating instructions are located at 32 above the display window 30.

A larger LED display window 34 is located at the top of the front of the housing to deliver stationary or moving advertising messages.

Four windows 36, 38, 40 and 42 are provided in the front panel 20. Immediately below each of the four windows is a ticket dispensing outlet 44, 46, 48 or 50, respectively. Each of the dispensing outlets has a pair of curved fingers 64 for holding the ticket until it is grasped by the customer.

Clearly visible through each of the four windows is an array 52, 54, 56, or 58, respectively, of lottery tickets. The tickets are visible at all times, both when they are stationary, and when they are moving during the ticket dispensing operation of the machine.

Figure 5:
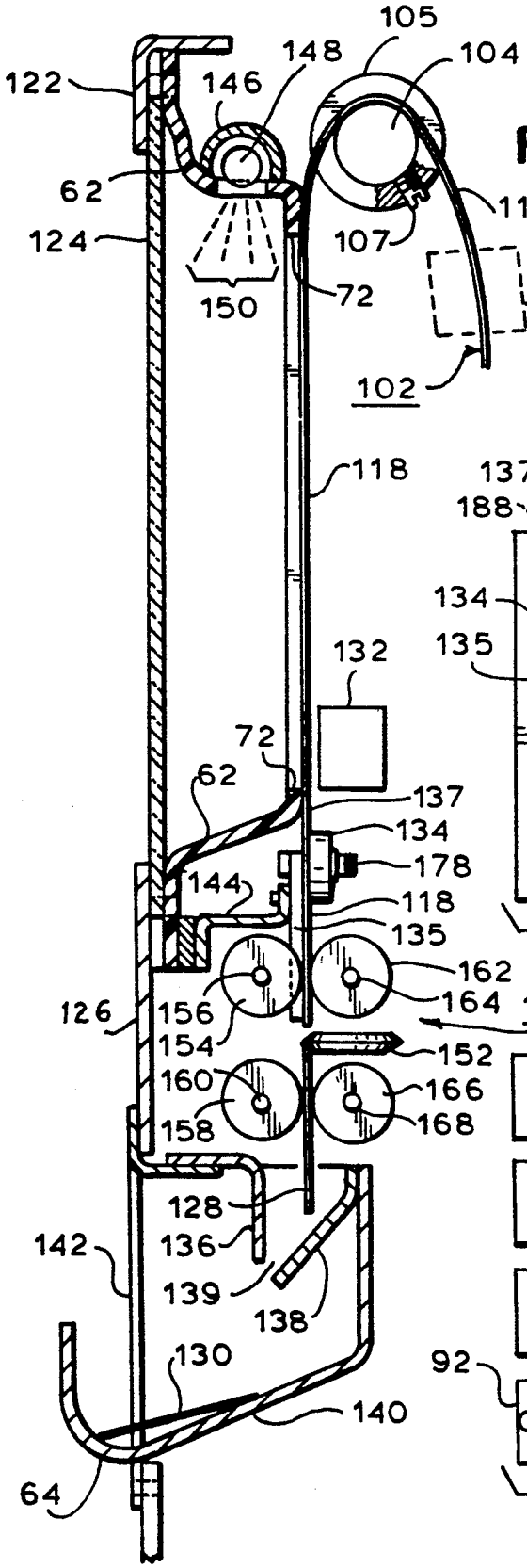
FIG. 5 is a cross-sectional view taken along lines 5—5 of FIG. 4.

As it is shown in FIG. 5, each of the windows includes a bezel 62 with a rectangular opening 72 in the rear and a cover plate 124 of tempered glass or Lexan or similar transparent break-resistant material.

Separate locks 66, 68 and 70 are provided, respectively, for the front panel 20, the bill receiver unit 22, and the front door 18 of the base portion 14 of the unit 10.

The method of issuing the tickets and the selection process by the customer now will be explained.

Figure 2:
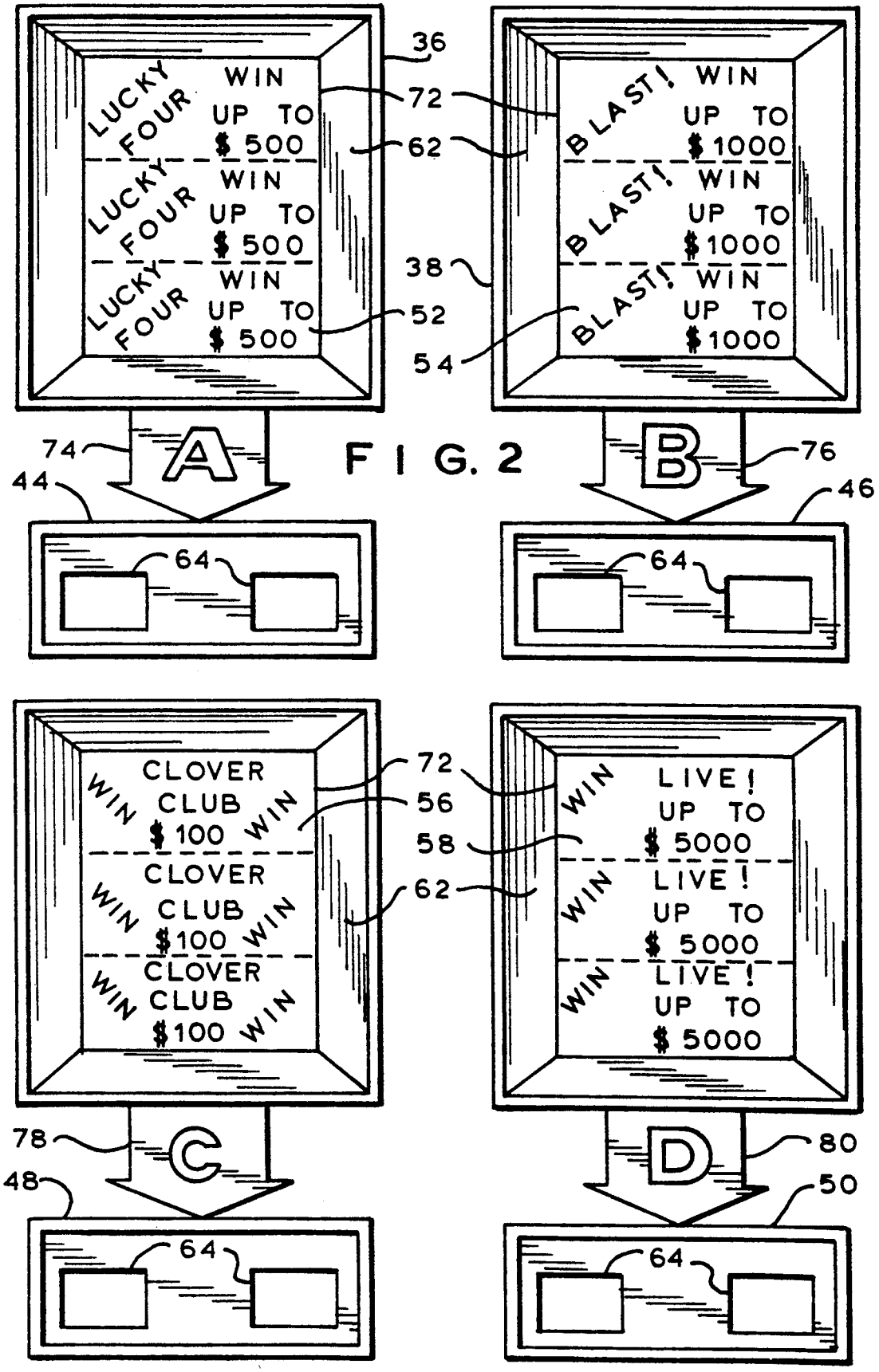
FIG. 2 is a front elevational view of a portion of the machine shown in FIG. 1.

FIG. 2 is an enlarged view of the windows and dispensing outlets of the machine 10. In FIG. 2, each of the four windows shows most of the front faces of three lottery tickets. The number of lottery tickets displayed in each window depends upon the length (the vertical dimension in FIG. 2) of the particular tickets involved. Each of the windows displays tickets in a different game conducted by the lottery authority in the jurisdiction in which the machines are used.

Figure 3:
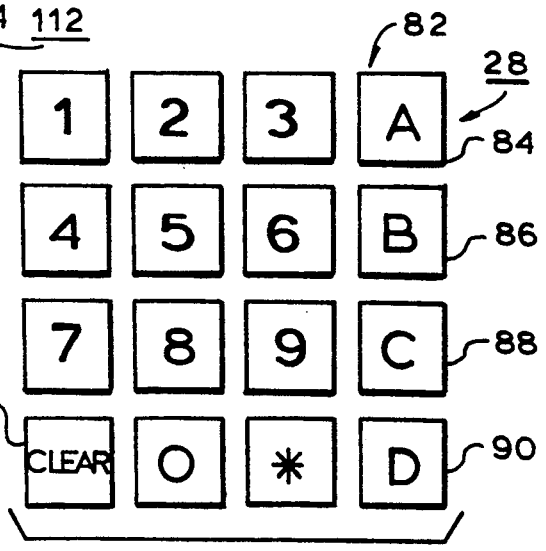
FIG. 3 is an enlarged front elevation view of the keypad of the unit shown in FIGS. 1 and 2.

Referring now to FIG. 3, the keypad 28 includes a row 82 of window selection pushbuttons 84, 86, 88 and 90. As it is shown in FIGS. 1 and 2, beneath each window is a letter and arrow 74, 76, 78 or 80 corresponding to the letter on one of the pushbuttons 84, 86, 88 or 90. Thus, if the customer wishes to play game A, he or she inserts money in the bill acceptor, and the amount of credit the customer has appears on the display 30. The customer then presses number keys on the keypad 28 to input the number of tickets desired. The customer then presses pushbutton 84 (FIG. 3) to select the game illustrated in the window 36 (see FIG. 2), and the machine moves the tickets downwardly past the window 36 (FIG. 2) and dispenses them through the outlet 44 one-by-one. As the tickets are dispensed one-at-a-time, the amount of credit displayed on the display 30 decreases, one monetary unit at a time. The unit by which the credit decreases depends on the price of the ticket selected.

If the customer mistakenly presses one of the game select pushbuttons 82 first, the machine will dispense only one ticket. This advises the customer that he or she should select the number of tickets desired before selecting the game.

If the customer has not used up all of his or her credits, and then wishes to play game D, the customer presses pushbutton 90 (FIG. 3) and the lottery tickets 58 move downwardly and are dispensed through the outlet 50 one-by-one until the credits are used up.

In the embodiment of FIGS. 8 through 10, the customer selects tickets from one of the arrays displayed on a video screen 218, and tickets are issued through one of two outlets 220 and 222. Otherwise, the selection process is the same as for the embodiment using windows.

If the tickets are of the "instant winner" variety, the customer then can scratch off an opaque coating over one area of each of the tickets to see whether he or she is an instant winner.

It should be understood that the vending machine also can be used to dispense tickets other than lottery tickets and other than instant winners. Again, the ticket display gives the customer selection, confidence and entertainment.

TICKET FEEDING

Figure 4:
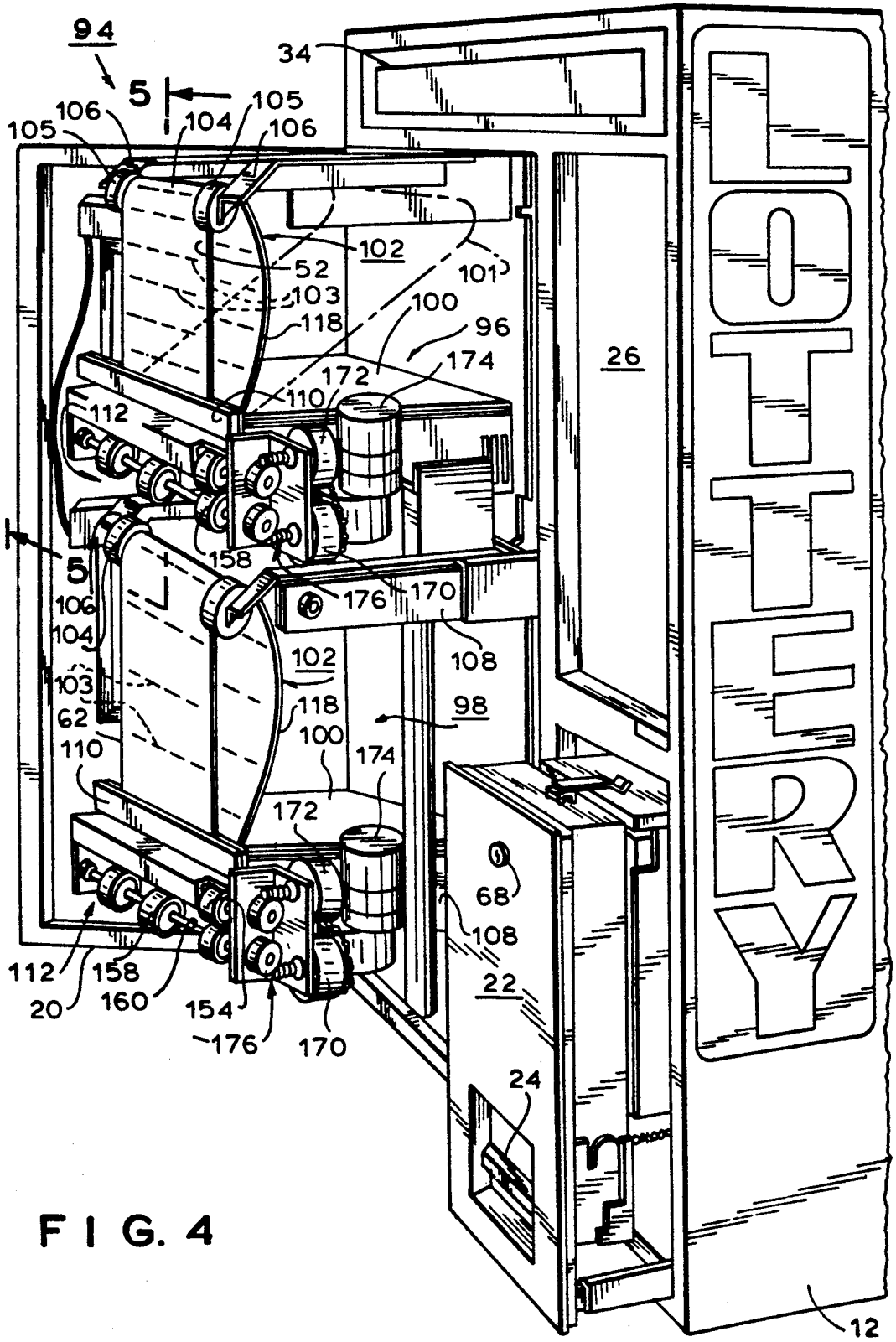
FIG. 4 is a perspective, partially broken-away view of another machine, similar to that shown in FIGS. 1 and 2.

FIG. 4 is a perspective, partially broken away view of a two-window lottery ticket vending unit which is substantially the same as the one shown in FIG. 1, except that it has two windows instead of four, and does not have a base portion 14. The elements of the control panel 26 are not shown, for the sake of simplification of the drawing. The front cover 20 of the unit has been unlocked and opened outwardly on its hinges. Two lottery ticket feed and dispensing mechanisms 96 and 98 for the two windows of the machine are shown pulled out of the machine housing and supported in the extended position by tracks 108. This gives access to the mechanisms for servicing and facilities replenishing ticket stocks.

Each of the feed units 96 and 98 includes a tray for holding a substantial stack 100 of lottery tickets in fan-fold form. The lottery tickets are printed on a continuous sheet or strip of card stock in which the individual tickets are delineated from one another by perforated lines 103—lines of weakness along which the tickets can be separated easily.

Referring now to FIG. 5 as well as FIG. 4, the strip to tickets extends upwardly as shown at 102 or 101 off of the stack, and passes over a roller 104 with enlarged end stops 105, and past the opening 72 (FIG. 5) in the bezel forming the rear of the window structure. The roller 104 is rotatably mounted on arms 106 which extend downwardly as shown in FIG. 4.

Each of the end stops 105 can be moved longitudinally along the roller 104 by loosening a set-screw 107 and tightening it again in the new position. This permits adjustment of the distance between the end stops to guide ticket strips 118 of varying widths.

Referring now to FIG. 5, the bezel 162 is mounted in the hinged front panel 20 whose frame 122 is shown in the upper left-hand corner of FIG. 5. The transparent window 124 is clamped between the front panel parts 122 and 126 and the outer flange of the bezel 62. Thus, the window structure moves away from the ticket strip 118 and feeder/burster mechanism to give optimum access to the internal parts of the mechanism.

The strip 118 of lottery tickets moves downwardly past the opening 72 in the bezel and through a pair of edge guides 134 (also see FIG. 6), and through a feeding and bursting mechanism indicated generally at 112 in FIG. 5. The feeding and bursting mechanism 112 is essentially identical to that disclosed in the above-identified copending patent application, except that it has been rotated through 90° to dispense tickets downwardly. It will not be described in detail herein; rather, the disclosure of that mechanism, and all other disclosure in the pending application, hereby is incorporated herein by reference.

Each feeding and bursting mechanism 112 includes four drive rollers 154, 158, 162 and 166 mounted, respectively, on shafts 156, 160, 164 and 168 (also see FIG. 4). A rotary bursting wheel 152 (FIG. 5) is provided and is mounted to rotate and move across the strip 118 of lottery tickets at or near the location of a perforation so as to press to the left on the ticket stock and separate a ticket 128 from the end of the strip.

The severed ticket 128 is dispensed past metal guides 136 and 138 which form a relatively narrow outlet opening 139 through which outfeed rollers 158 feed the severed ticket 128 and issue it through the opening 139 into a receptacle formed by the member 140 with the upturned arms or fingers 64. A severed ticket 130 is shown resting in the receptacle ready to be grasped. As it can be seen in FIGS. 1 and 2, there is an ample space between the fingers 64 so that the customer easily inserts his own fingers to grasp the tickets.

The outlet opening 139 is narrow and is recessed in the housing so it is not easy to reach from outside. In addition, the spacing of outlet 139 from the burster blade 152 is such that a ticket will not emerge through the opening 139 until it has been severed from the ticket strip 118. By this means, it is made very difficult for someone to reach into the machine, grasp the uncut ticket strip 118, and pull out a strip of tickets.

As it is disclosed more fully in the above-identified copending patent application, the bursting and feeding mechanism includes a precise code wheel and detector arrangement for making certain that the perforations accurately line up with the bursting wheel 152. However, the use of the bursting wheel to tear the tickets from one another has the added benefit of automatically adjusting any misalignment, thus providing highly reliable feeding and issuing of whole, undamaged tickets.

As it can be seen at the upper portion of FIG. 5, a lamp 148 with a housing 146 is mounted adjacent a slot in the top of each bezel so that light rays 150 shine downwardly to illuminate the tickets at each window to make them more visible, readable and attractive.

Figure 6:
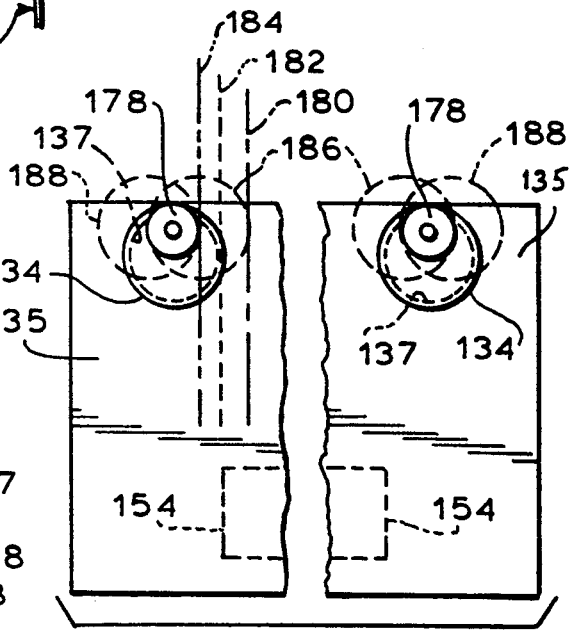
FIG. 6 is a partially broken-away elevation view of a portion of the structure shown in FIG. 5.

FIG. 6 shows the adjustable edge-guiding members 134. The members 134 are cams which are pivotably mounted on a support plate 135 adjacent opposite edges of the ticket strip 118. Each of the cams 134 is circular with its pivot point located considerably outwardly from its center so that rotation of the element 134 will bring its edge closer to or farther away from the opposite guide 134. Each cam element 134 has a recessed edge 137 which forms a groove in which the edge of the ticket strip is guided.

Two different positions, shown in dashed outline at 186 and 188 are shown for the cam elements 134, in addition to the position shown in solid outline. With the cams in position 186, the left edge of the ticket strip would be located at 180. With the cam elements rotated to their solid line position, the left edge of the strip would be located at 184. The right edge would be similarly located relative to the right-hand cam 134. The adjustment of these elements can be made by a service representative to accommodate ticket strips of varying widths.

The position of each cam 134 is adjustable by loosening a threaded fastener 178 with a knurled knob, rotating the cam 134 to its new position, and tightening the knob 178 again to hold it in its new position.

Also disclosed in FIG. 5 is an optional printer 116, like the one shown in FIG. 9 of the co-pending application, which can be used to imprint information on the rear surface of each lottery ticket as it passes by. The information which can be imprinted is information such as the location of the vending machine, the identification of the ticket itself, etc., as more fully disclosed in the co-pending application.

Also shown in FIG. 5 is an optional bar-code reader 132 which is positioned to read a bar-code printed on the back of each lottery ticket. This reader can read the identification of the ticket's lot number; the identification of each individual ticket; the ticket batch number; the ticket manufacturer; the ticket manufacturing date; and the game represented by the ticket; whether the ticket is a winner; and how much winnings the ticket is worth. This information then can be used for accounting and security purposes.

CONTROL SYSTEM

Figure 7:
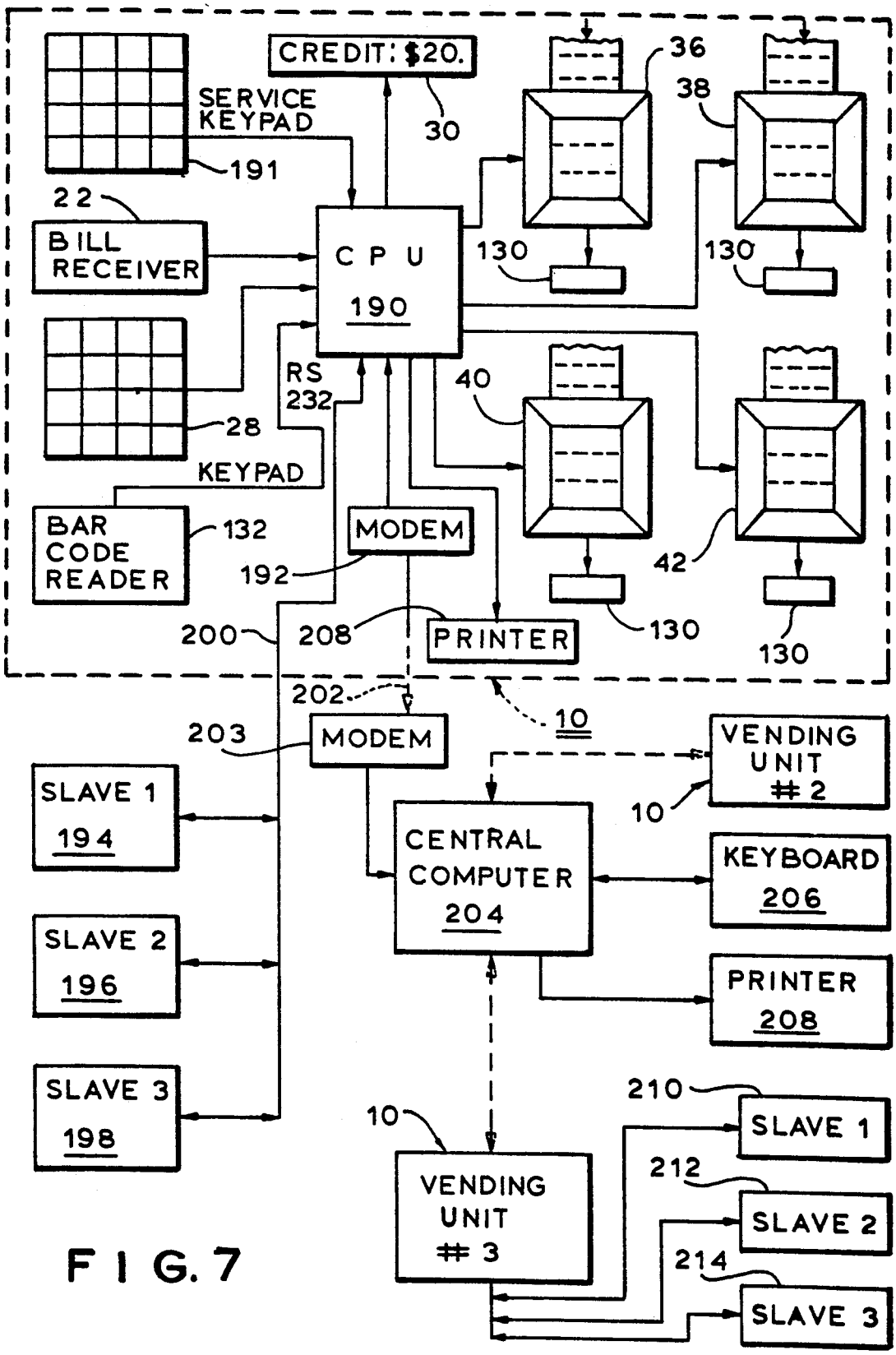
FIG. 7 is a schematic block diagram of a communication and computer system incorporating the present invention.

FIG. 7 shows a ticket vending system including a number of vending units 10 and a central computer 204.

Each unit 10 has a microprocessor whose CPU 190 is shown in FIG. 7. The bill receiver or acceptor 22 indicates the denomination of the bill and its authenticity. The CPU computes the amount of credit due to the customer and displays it on the LED display 30 so the customer knows how much credit he or she has at any given moment. The bill receiver is adapted to accept bills in denominations of $1.00, $5.00, $10.00 and $20.00 in U.S. currency, or other multiple denominations of the currency of other countries.

The keypad 28 then is operated by the customer to select one of the four games available, and to select the number of lottery tickets desired. This information is operated upon by the CPU 190 and is used to cause the proper number of tickets 130 to be issued from the selected window 36, 38, 40, or 42. Then the amount of credit shown on the display 30 is reduced by one unit as each ticket is issued so that the customer can see that he is being charged the proper amount for each ticket. The customer then can select other windows and other numbers of tickets until his credit is used up.

Communication between the vending units 10 and the central computer 204 preferably is through telephone lines 202 by means of a modem 203, or an optional dial-up modem 192 in each of the units 10.

If desired, in order to save hardware costs and telephone charges, a group of four or more vending units can be operated in a master-slave relationship with one unit 10 being the master and three units 194, 196 and 198 being connected by cable as slaves to the master unit. In this manner, there is communication with the central computer only through the master unit. This reduces the number of telephone lines needed to one, and reduces hardware costs in the slave units. The master-slave groupings are convenient to use when multiple vending machines are located close to one another, as in a single building.

FIG. 7 shows, in the lower portion, another vending unit 10 with three slaves 210, 212 and 214. Still another vending unit 10 without any slaves is shown to the right and above the central computer 204 in FIG. 7.

A keyboard 206 and a printer 208 are connected to the central computer at the same location as the computer so that ticket agents can input and output the information necessary to control the vending units and check on their operation and security.

A printer 208 is located inside of each vending machine 10. Such a printer prints a record of all transactions and data to be discussed below, and can be used by the agent servicing the machine for accounting and other purposes to be disclosed below, or which have been disclosed in the co-pending application.

The adjustment for different lengths of tickets is set electronically through a service keypad 191 located internally in the housing 12. Alternatively, the length adjustment can be set electronically from the central computer.

The wording of the advertising sign can be changed at will, preferably from the central computer 204. It is typically a LED display. It can be stationary or moving, as is well-known in the art.

The "clear" button (FIG. 3) on the keypad allows the customer to correct an erroneous keypad entry. The programming of the microprocessor in the vending machine advises a customer by way of the display 30 when the mechanism dispensing a particular one of the game tickets is inoperative, and then will advise the customer to chose another game. The bill receiver will not accept any currency if all games are inoperative.

The specific circuitry and program routines used in the unit 10 are more fully described in the co-pending patent application and will not be elaborated upon here.

SPECIFIC EXAMPLE

In a particular machine like that shown in FIG. 1 which has been built and successfully operated, the following specific features have been incorporated. The currency acceptor used is a Mars Electronics Model L20-U1M currency acceptor capable of accepting $1.00, $5.00, $10.00 and $20.00 bills in U.S. currency. It has a 1,000 bill capacity stacker to stack the bills.

The character display 30 is a 20 character light emitting diode display. It displays prompt messages at regular intervals to assist the customer in making his purchase.

An audible alarm is provided in case the cabinet door is open or the power input to the unit is too low.

The internal printer 208, is a 16-column thermal printer.

The imprinter 116 consists of a stamp roller and an ink roller in a self-contained replaceable assembly capable of making 100,000 impressions.

DATA PROCESSING

The following data is to be stored in the memory of each vending unit. Listed below are the means by which the data is entered ("Entry Source"), and whether the data is encrypted pursuant to a secret code which is used for security purposes:

| ENTRY | SOURCE | ENCRYPTED |
|---|---|---|
| A. Modem Communications Password | Host | Yes |
| B. Number of Ticket Loaded/Added | Keypad | No |
| C. Number of Tickets To Be Dispensed | Keypad | No |
| D. Number of Tickets Remaining | Calculation | No |
| E. Agent Number (Up to Six Digits) | Host | Yes |
| F. Machine Number (Up to Eight Digits) | Host | Yes |
| G. Number of Times Unit is Opened | Auto | No |
| H. Agent Commission: to 1/10th of 1% | Host | Yes |
| I. Single Customer Message (80 Character Buffer) | Host | Yes |
| J. Ticket Purchase Price ($1 Increments) | Host | Yes |
| K. Primary and Secondary Host Phone # | Host | Yes |
| L. Date and Time | Host | Yes |
| M. Keypad Sign-on Password | Host | Yes |
| N. Ticket Length (1.25"-2.50") | Keypad | No |

The "keypad" referred to above is the service keypad 191 (FIG. 7) which is not accessible by the public. Alternatively and preferably, the keypad 28 can be used as the service key pad by use of software and a keypad sign-on password by the service representative. The display 30 also serves as a diagnostic message display during servicing.

Time Increments for Filling Data

The above data is kept for each of the following time increments:

A. Latest Complete Week (Sun-Sat)
B. Current Week
C. Current Day
D. Most Recent Complete Day (Midnight to Midnight)
E. Second Most Recent Complete Day

Reports

The following reports are generated by the system and its software:

A. Current Sales Report: for current day.
B. Daily Sales Report:
  1. For most recent complete day
  2. For second most recent complete day
C. Weekly Sales Report
  1. For latest complete week
  2. For current week to date
D. Invoice: for latest complete week only.

Reports—Detailed

The following reports are made available to agents via the thermal printer 208 in the vending machine, and to the State or other operating authority via modem. All data remains stored until the file is needed for the next time increment.

A. Current Sales Report Contents:
  1. "Current Sales" title
  2. Current date and time
  3. Agent Number
  4. Machine Number
  5. Sales since last report
  6. Playout since last report
  7. Net cash since last report
  8. Total Sales for current day
  9. Total payout for current day
  10. Net cash for current day
  11. Service entries. (Two digits Max)
B. Daily sales report contents:
  1. "Daily Sales Report" title
  2. "For 00/00/00". Add time for current day only.
  3. Agent number
  4. Machine number
  5. Sales
  6. Pay out total
  7. Net cash amount (sales−payout=net cash)
  8. Service entries (two digits max)
C. Weekly sales report content:
  1. Same format and content as daily report
  2. "For W/E 00/00/00: (W/E=Week Ending. Use Sat Date)
D. Invoice Content:
  1. "For W/E 00/00/00" (Sat Date)
  2. Agent Number
  3. Machine Number
  4. Sales
  5. Payout Total
  6. Commission earned
  7. Net Due to State (or from State)

REPORT FORMAT

Following is the preferred format for each of the foregoing reports:

| | |
|---|---|
| DAILY SALES RPT | |
| FOR 00/00/00 | |
| AGENT # | 000000 |
| MACH # | 00000000 |
| SALES | $0000.00 |
| PAID | $000.00 |
| NET | $0000.00 |
| SE | 00 |
| WEEKLY SALES REPT | |
| FOR W/E 00/00/00 | |
| AGENT # | 000000 |
| MACH # | 00000000 |
| SALES | |
| PAID | |
| NET | |
| SE | |
| WEEKLY INVOICE | |
| FOR W/E 00/00/00 | |
| AGENT # | 000000 |
| MACH # | 00000000 |
| SALES | $0000.00 |
| PAY | $000.00 |
| COMM | $000.00 |
| NET DUE | $0000.00 |
| CURRENT SALES | |
| 00/00/00 0000:00 | |
| AGENT # | 000000 |
| MACH # | 00000000 |
| FOR CURRENT DAY | |
| SALES | $0000.00 |
| PAID | $000.00 |
| NET | $0000.00 |
| SE | 00 |
| FOR THIS REPORT | |
| SALES | $0000.00 |
| PAID | $000.00 |
| NET | $0000.00 |
| SE | 00 |

Communications with Host Computer

Communication from the host computer 204 to the unit 10 is accomplished with a 2400 baud modem over a telephone network. The host computer calls the unit 10, and sends a ten-character ASCII password. The vending unit is then ready to transmit its encrypted data to the host using CRC XMODEM protocol. After the vending unit sends its data, it goes into the receive mode. The host will then send encrypted data to the vending unit using CRC XMODEM protocol.

Dial-Up Modem

The internal modem 192 for dial-up communications operates at a 2400 baud rate.

The modem 192 will answer calls within a time period programmed by the host computer. The service operator may also override the modem answer time period to set the modem to answer NOW.

Master/Slave Serial Data Communications

A master/slave serial data communications bus 200 (FIG. 7) is used to communicate between the master and slave units. This is a bidirectional bus and supports one master and three slave units. The master is connected to the telephone system and will allow a host computer to collect data from four terminals through one telephone line 202.

Video Display Embodiment

FIGS. 8 through 10 show an alternative embodiment of the invention in which a video display is used, instead of separate windows, to display arrays of the different tickets.

FIG. 8 is a front elevation view of a vending machine constructed in accordance with this embodiment of the invention. The unit 216 does not have a base cabinet like the cabinet 14 shown in FIG. 1, but instead, like the embodiment shown in FIG. 4, rests upon a table or stand (not shown).

Each of the components and elements of the machine 10 shown in FIG. 1 which is the same as in FIG. 1 bears the same reference numeral.

Instead of the four windows in the unit 10, a video display screen 218 is provided for displaying a plurality of arrays of lottery tickets. Each array is designated by one of the letters A, B, C, D, E and F in FIG. 8. Instead of one dispensing outlet for each array, as in the FIG. 1 embodiment, there are only two dispensing outlets 220 and 222.

FIG. 9 is a side elevation schematic view showing one of two burster mechanisms 112 receiving ticket strips 225, 227 or 229 from storage bins 224, 226 or 228, respectively. The unit 112 contains means for selecting one from among the three ticket storage bins to feed and disburse tickets from. When the customer selects one of the three lottery ticket arrays A, B or C, the unit 112 behind outlet 220, which receives tickets from those three supplies, selects the appropriate strip to feed through the burster unit, separates the proper number of tickets, and dispenses them through the outlet opening 220.

Similarly, a separate mechanism like that shown in FIG. 9 is located behind the outlet opening 222 to service the arrays D, E and F. When one of those arrays has been selected, the burster 112 selects a ticket strip from one of the three bins that feed into it and issues tickets from that strip.

FIG. 10 is a schematic block diagram of the control circuit for the system shown in FIGS. 8 and 9. It is essentially the same as that shown in FIG. 7, except that the CPU 190 delivers control signals to the units 112 which control which of the three sources it feeds tickets from. The CPU also selects which of the two units 112 is enabled, depending on the array selected by the customer.

A video memory 230 is provided to store digitized graphic representations of the lottery tickets in each of the six displays on the screen. These ticket images are digitized by conventional graphic digitizing means, and the digital signals are stored in the video memory 230 periodically as the games and the lottery tickets are changed. The digital signals needed for proper operation can be stored and distributed to many different remote machines from the central computer 204. Alternatively, the unit 216 can be provided with a small disk drive or tape player, and the service representative can carry the digital images on a disk or tape and use the disk drive or tape to read them into the machine 216 when he comes to load into the machine a new batch of lottery tickets for a new game.

The video memory 230 is of a conventional type which contains any digital to analog conversion circuitry to deliver signals suitable for display on the video monitor 218.

In accordance with another aspect of the invention, each of the arrays of ticket images A, B, C, D, E and F can be made to move downwardly as a ticket is issued. The array moves in the same manner as the tickets move past the windows in FIGS. 1 and 2. This can be done by ordinary scrolling techniques. Although only 2 tickets are shown in each of the arrays A, B, C, D, E and F, it should be understood that each array can be made to contain more tickets, if it is desired to do so.

When the supply of any one particular lottery ticket is exhausted, the representation of that ticket on the video screen disappears and is replaced by a legend saying "Sold Out".

The device shown in FIGS. 8, 9 and 10 has the advantage that it is relatively compact and may require fewer burster and feeder mechanism. It would be possible, for example, by extension of the principles discussed above, to use only one burster and feeder mechanism to service four or five or more different supplies of lottery tickets.

Another advantage of the device shown in FIGS. 8 through 10 is the arrays A, B, C, D, E and F appear on a video screen. This may make viewers more comfortable in that they will be viewing the tickets in a familiar format. Also, the video screen, which preferably is a color receiver, will deliver the images of the tickets in vivid, bright colors which will be easy to see in a darkened room, such as in a tavern or cafe. For these reasons, it may be desired to use the video screen to display the ticket images, even though a separate burster and feeder mechanism is used for each type of ticket.

The above description of the invention is intended to be illustrative and not limiting. Various changes or modifications in the embodiments described may occur to those skilled in the art and these can be made without departing from the spirit or scope of the invention. For example, either the ticket itself or a video image of a ticket should be considered to be a "representation" of the ticket. Means other than the specific ones described above can be used to create representations of tickets without departing from the invention.

I claim:

1. A ticket dispensing machine, comprising, in combination, a housing, at least one window in said housing through which tickets inside said housing can be seen but not touched by a person outside said housing, a dispensing outlet in said housing, electrically powered means for moving a continuous strip of tickets past said window, and for dispensing through said outlet a predetermined number of said tickets to an operator of said machine.

2. A machine as in claim 1 in which said housing has a plurality of said windows, and said moving means is adapted to move an array of tickets past each of said windows.

3. A machine as in claim 1 in which said tickets are lottery tickets.

4. A machine as in claim 1 including means for receiving a medium of monetary exchange, detecting the number of monetary units represented by said medium and dispensing the number of tickets corresponding to said number of monetary units.

5. A machine as in claim 1 in which said dispensing outlet is accessible to an operator in a position to see the tickets behind said window.

6. A machine as in claim 1 in which said dispensing means includes means for barring a person from grasping any ticket before it is dispensed through said outlet.

7. A ticket dispensing machine, comprising, in combination, a housing, at least one window in said housing through which tickets inside said housing can be seen but not touched by a person outside said housing, a dispensing outlet in said housing, moving means for moving an array of tickets past said window, and means for dispensing through said outlet a pre-determined number of tickets to an operator of said machine including bar-code reading means mounted adjacent the path of travel by said tickets for reading a bar code from said tickets and transmitting to central computer means the information so read.

8. A machine as in claim 7 in which the barcodes on said tickets represent one or more of the group consisting of; individual ticket identification; ticket bath identification; ticket lot numbers; ticket manufacturer; ticket manufacture date; the game represented by the ticket; whether the ticket is a winner; how much winnings the ticket is worth.

9. A ticket vending method, said method comprising the steps of:

(a) utilizing electrically powered drive means for moving a strip of mutually-attached tickets past a viewing window in a housing in a manner such that the tickets can be seen from outside said housing, and (b) issuing from said housing a pre-determined number of tickets from said array which are ordered by an operator.

10. A method as in claim 9 including the step of providing a plurality of windows in said housing, each with an array of tickets and powered drive means to move the array past it, and selecting among said arrays and issuing tickets from one of them.

11. A method as in claim 10 in which said tickets are lottery tickets, the tickets displayed through each of said windows representing a different lottery game to provide the customer with a variety of different games to select from.

12. A method as in claim 9 including the steps of providing a plurality of ticket vending machines in a particular locale, selecting one of said machines to be a master and the others to be slaves, and communicating data regarding the operation of said master and slave units through said master unit.

13. A lottery ticket vending machine comprising, in combination, a housing, display means for displaying an array of lottery ticket representations viewable from outside of said housing by a customer, said array representing tickets in said machine available for purchase, acceptor means for receiving and accepting a means of monetary exchange, and means for dispensing said tickets in a number corresponding to the amount of money input into said machine by said customer, in which said display means comprises at least one transparent window through which said array can be seen but not touched by said customer, and means for moving said array in said enclosure during the dispensing of said tickets, said tickets being formed in a continuous strip with individual tickets delineated from their neighbors by perforations, storage means in said housing for storing a supply of said tickets, feed means for feeding said strip past said window, separator means for receiving said strip, and after passing by said window and separating said tickets from one another, said dispensing means being adapted to dispense one or more tickets separated from said strip including sliding support means for mounting said storage, feed, separator and dispensing means in said housing, said housing having a removable panel and said support means being slidable out of said housing for ease of reloading and service.

14. A machine as in claim 13 in which said removable panel is a hinged front panel, said window being located in said front panel.

15. A machine as in claim 13 said housing having a front panel, said window comprising a bezel in said front panel, a transparent covering for the front of said bezel, and the back of said bezel being open, and guide means for guiding said strip along said back of said bezel.

16. A machine as in claim 13, including adjustable edge guide means for guiding the edges of said strip, said adjustable edge guide means comprising a pair of cams rotatable to change the spacing between them.

17. A lottery ticket vending machine comprising, in combination, a housing, display means for displaying an array of lottery ticket representations viewable from outside of said housing by a customer, said array representing tickets in said machine available for purchase, acceptor means for receiving and accepting a means of monetary exchange, and means for dispensing said tickets in a number corresponding to the amount of money input into said machine by said customer, in which said display means comprises at least one transparent enclosure through which said array can be seen but not touched by said customer, and means for moving said array in said enclosure during the dispensing of said tickets, including a lamp for illuminating said array.

18. A lottery ticket vending machine comprising, in combination, a housing, display means for displaying an array of lottery ticket representations viewable from outside of said housing by a customer, said array representing tickets in said machine available for purchase, acceptor means for receiving and accepting a means of monetary exchange, and means for dispensing said tickets in a number corresponding to the amount of money input into said machine by said customer, in which said display means comprises video display means for displaying a plurality of arrays of ticket images on a video screen.

19. A machine as in claim 18 including means for separately scrolling each of said arrays to produce motion as tickets represented by a selected array are being dispensed.

20. A machine as in claim 19 including video memory means for storing and delivering to said video display means signals to form said arrays under the control of electrical control circuitry.

21. A ticket dispensing machine, said machine comprising, in combination, a housing, at least one window in said housing through which tickets inside said housing can be seen but not touched by a person outside said housing, a dispensing outlet in said housing, moving means for moving an array of tickets past said window, means for dispensing through said outlet a pre-determined number of tickets to an operator of said machine, said tickets being formed in a continuous strip with individual tickets delineated from their neighbors by perforations, storage means in said housing for storing a supply of said tickets, separator means for receiving said strip after passing by said window and separating said tickets from one another, said dispensing means being adapted to dispense one or more tickets separated from said strip, including sliding support means for mounting said storage, feed, separator and dispensing means in said housing, said housing having a removable panel and said support means being slidable out of said housing for ease of reloading and service.

22. A machine as in claim 21 in which said removable panel is a hinged front panel, said window being located in said front panel.

23. A ticket dispensing machine, said machine comprising, in combination, housing, at least one window in said housing through which tickets inside said housing can be seen but not touched by a person outside said housing, a dispensing outlet in said housing, moving means for moving an array of tickets past said window, means for dispensing through said outlet a pre-determined number of tickets to an operator of said machine, said tickets being formed in a continuous strip with individual tickets delineated from their neighbors by perforations, storage means in said housing for storing a supply of said tickets, separator means for receiving said strip after passing by said window and separating said tickets from one another, said dispensing means being adapted to dispense one or more tickets separated from said strip, said housing having a front panel, said window comprising a bezel in said front panel, a transparent covering for the front of said bezel, and the back of said bezel being open, and guide means for guiding said strip along said back of said bezel.

24. A method of dispensing tickets from a machine said method comprising the steps of:

(a) displaying a plurality of arrays of ticket representations, each of said arrays representing tickets available for dispensing from said machine,
(b) selecting tickets from one of said arrays,
(c) dispensing a selected number of said tickets, and
(d) causing the selected array to move to indicate the dispensing of tickets therefrom, in which said ticket representations comprise video images of said tickets displayed on a video screen.

* * * * *